US007683316B2

(12) United States Patent
Takeshita et al.

(10) Patent No.: US 7,683,316 B2
(45) Date of Patent: Mar. 23, 2010

(54) ION TRAP MASS SPECTROMETER

(75) Inventors: Kengo Takeshita, Kyoto (JP); Kiyoshi Ogawa, Kyoto (JP)

(73) Assignee: Shimadzu Corporation, Kyoto-fu (JP)

( * ) Notice: Subject to any disclaimer, the term of this patent is extended or adjusted under 35 U.S.C. 154(b) by 161 days.

(21) Appl. No.: 12/117,311

(22) Filed: May 8, 2008

(65) Prior Publication Data

US 2008/0277580 A1 Nov. 13, 2008

(30) Foreign Application Priority Data

May 9, 2007 (JP) ..... 2007-124038

(51) Int. Cl.
*H01J 49/42* (2006.01)

(52) U.S. Cl. ..... 250/292; 250/281

(58) Field of Classification Search ..... 250/292, 250/281

See application file for complete search history.

(56) References Cited

U.S. PATENT DOCUMENTS 7,285,773 B2 * 10/2007 Ding et al. ..... 250/282
2008/0035841 A1 * 2/2008 Ding ..... 250/283
2009/0278042 A1 * 11/2009 Izumi et al. ..... 250/287

FOREIGN PATENT DOCUMENTS

JP 2003-512702 A 4/2003
WO 01/29875 A2 4/2001

OTHER PUBLICATIONS

O. Furuhashi, et al., "Development of Digital Ion Trap Mass Spectrometer," Shimadzu Review, vol. 62, No. 3/4, 2005, pp. 141-151, English Abstract.

* cited by examiner

*Primary Examiner*—Kiet T Nguyen
(74) *Attorney, Agent, or Firm*—Sughrue Mion, PLLC

(57) ABSTRACT

The number of times of repetition of mass spectrometry analysis for integrating mass profiles is reduced to facilitate reduction in measurement time-period and increase a signal intensity. In a state when ions are trapped by a high-frequency electric field formed within an ion trap, a rectangular-wave high-frequency voltage to be applied from a main voltage generation section to a ring electrode is temporarily stopped, and next ions are introduced from an ion entrance port into the ion trap in a state when only a static electric field exists within the ion trap. The high-frequency voltage application is restarted while at least a part of previously-trapped ions remain within the ion trap, to trap the newly-introduced ions in addition to the previous ions so as to increase an amount of ions to be accumulated, and the accumulated ions are subjected to the mass spectrometry analysis.

8 Claims, 4 Drawing Sheets

ION TRAP MASS SPECTROMETER

BACKGROUND ART

1. Technical Field

The present invention relates to an ion trap mass spectrometer comprising an ion trap operable to confine ions therein by an action of a high-frequency electric field.

2. Description of the Related Art

In late years, an ion trap mass spectrometer utilizing a three-dimensional quadrupole ion trap has been widely used as a highly-sensitive mass spectrometer. Typically, the three-dimensional quadrupole ion trap comprises one ring electrode having an inner surface in the shape of a hyperboloid of revolution of one sheet, and a pair of endcap electrodes disposed in opposed relation to each other across the ring electrode to have inner surfaces in the shape of a hyperboloid of revolution of two sheets.

In addition to the above ion trap, a basic configuration of the ion trap mass spectrometer includes an ion source operable to ionize a target substance to be measured, an ion transport optical system operable to transport ions produced by the ion source and introduce them into the ion trap, and an ion detector operable to detect each ion, wherein ions produced by the ion source are transported and introduced into the ion trap by the ion transport optical system to trap the ions, whereafter only a part of the ions having a specific mass are excited in a sequential manner so as to separate the ions depending on their masses, and the mass-separated ions are discharged from the ion trap and introduced to the ion detector so as to be subjected to detection. Alternatively, the mass spectrometer may be configured such that the ion trap is used for temporarily accumulating ions (or for fragmenting ions, on a case-by-case basis), instead of being used for the mass separation, and various ions concurrently discharged from the ion trap are introduced to a time-of-flight mass spectrometer to perform mass separation therein, whereafter the mass-separated ions are subjected to detection. Although this configuration is generally referred to as "ion trap time-of-flight mass spectrometer (IT-TOFMS)", such a configuration is intended to be also covered by the term "ion trap mass spectrometer" as used in this specification.

In the above ion trap mass spectrometer, when the ion source is placed in a vacuum atmosphere, ions are transported to a mass separation/detection section in a subsequent stage, using an electrostatic ion transport optical system, such as an Einzel lens. Differently, when the ion source is placed in an atmospheric-pressure atmosphere or a low-vacuum atmosphere, the ions are transported to the mass separation/detection section, using a high-frequency electric field-based ion transport optical system, such as a high-frequency ion lens, while employing the configuration of a differential pumping system, because the mass separation/detection section is typically placed in a high-vacuum atmosphere.

The typical conventional ion trap is configured to apply a sine-wave high-frequency voltage to the ring electrode to form a trapping high-frequency electric field in a space surrounded by the electrodes, so that ions are confined therein while being oscillated by the high-frequency electric field. In this connection, a digital ion trap (DIT) has been recently developed, wherein a rectangular-wave voltage is applied to the ring electrode, in place of the sine-wave voltage, to perform ion confinement (see, for example, the following Patent Document 1 and Non-Patent Document 1).

In the conventional analog-type ion trap of the former, an LC resonator is used for generating a sine-wave high-frequency voltage, and the amplitude of the voltage is changed to control a mass range of trappable ions. In the digital-type ion trap of the latter, a DC voltage is switched at a high speed to generate a rectangular-wave high-frequency voltage, and the frequency of the high-frequency voltage is changed while keeping the amplitude thereof constant, to control the mass range of trappable ion. Thus, in terms of the amplitude of a high voltage to be applied to the ring electrode, the digital type requires a smaller value as compared with the analog type, which provides an advantage of being able to form a power supply circuit at low cost and avoid the occurrence of undesirable electrical discharge. Therefore, in principle, the digital type is free from restrictions on the mass range of trappable ions caused by electrical discharge in the analog type.

In cases where a sample is a biological sample, a laser desorption/ionization (LDI) source, such as a matrix-associated laser desorption/ionization (MALDI) source, is often used as the above ion source for producing ions to be trapped by the ion trap.

In an ion trap mass spectrometer comprising a combination of the MALDI source and the DIT, a sample is irradiated with a laser beam in pulsed form once and resulting ions arising from the sample are introduced into the ion trap. Then, after stably trapping the introduced ions within the ion trap, a part of the ions having a specific mass-to-charge ratio are oscillated and discharged from the ion trap, and the mass-separated ions are subjected to detection using the ion detector. A mass-to-charge ratio of oscillating ions is scanned to perform mass scanning, and a mass spectrum is created based on a detection signal obtained from the mass scanning.

However, the mass spectrum obtained by a single cycle of the above mass spectrometry analysis has a low S/N ratio, because the MALDI source is generally highly likely to fail to produce a sufficient amount of ions by one laser beam irradiation. Thus, the following cycle: ion production based on laser beam irradiation→ion introduction into the ion trap→ion trapping (cooling)→mass separation/detection, is repeated, and resulting mass profiles are subjected to an integration processing to provide an enhanced SN ratio. Although the number of the cycles may be increased to provide a more improved S/N ratio of the mass spectrum, a measurement time required for acquiring a measurement result, i.e., a final mass spectrum, will be increased to cause a problem about low throughput.

Particularly, in mass spectrometry imaging where a laser-beam irradiation position is scanned on a sample to perform two-dimensional mass spectrometry analysis, it is necessary to repeat the mass spectrometry analysis for a large number of measurement points. Thus, an improvement in the S/N ratio based in the above technique requires an awful lot of measurement time.

In the ion trap mass spectrometer configured to perform ionization under an atmospheric pressure using the MALDI source or the like, ions are introduced into the ion trap via the ion transport optical system based on the high-frequency electric field, as described above, wherein ions can be introduced into the ion trap after accumulating the ions in the ion transport optical system once. However, due to a mass dependence of ion transport efficiency in this type of ion transport optical system, there is another problem about limitation in a mass range of ions introduceable into the ion trap.

[Patent Document 1] JP 2003-512702A

[Non-Patent Document 1] Furuhashi, Takeshita, Ogawa, Iwamoto, "Development of Digital Ion Trap Mass Spectrometer", Shimadzu Review, Shimadzu Review Editorial Department, Mar. 31, 2006, Vol. 62, No. 3·4, pp. 141-151

SUMMARY OF THE INVENTION

In view of the above problems, it is a primary object of the present invention to provide an ion trap mass spectrometer capable of enhancing an S/N ratio in mass spectrometry analysis. It is another object of the present invention to provide an ion trap mass spectrometer capable of reducing a measurement time required for acquiring measurement data having the same level of quality (e.g., S/N ratio) as that of conventional ion trap mass spectrometers, to contribute to enhancement in analytical throughput, and reduction in cost. It is yet another object of the present invention to provide an ion trap mass spectrometer capable of widening a mass range of ions analyzable in one cycle of mass spectrometry analysis.

In order to achieve the above objects, the present invention provides an ion trap mass spectrometer which includes an ion source operable to produce ions, and an ion trap operable to trap ions by means of an electric field formed in a space surrounded by a plurality of electrodes, wherein ions produced by the ion source are introduced into the ion trap so as to be trapped therein, and then the trapped ions are mass-separated by the ion trap, or mass-separated after being discharged from the ion trap, whereafter the mass-separated ions are subjected to detection. The ion trap mass spectrometer is characterized by comprising: a) voltage application means operable to apply a rectangular-wave high-frequency voltage to at least one of the plurality of electrodes constituting the ion trap so as to form an ion-trapping high-frequency electric field within the ion trap; and b) control means operable to control the voltage application means in such a manner as to, in a state when ions are trapped within the ion trap by applying the rectangular-wave high-frequency voltage to the at least one of the plurality of electrodes, temporarily stop the high-frequency voltage application so as to form a static electric field within the ion trap to introduce ions from an outside of the ion trap, and, after an elapse of a given time, re-start the high-frequency voltage application so as to trap the newly-introduced ions in addition to the previously-trapped ions.

In one typical embodiment of the present invention, the ion trap may be composed of a three-dimensional quadrupole ion trap having a ring electrode and a pair of endcap electrodes. In this case, the rectangular-wave high-frequency voltage is applied to the ring electrode to allow the ion-trapping high-frequency electric field to be formed within the ion trap.

In the ion trap mass spectrometer of the present invention, the voltage application means is configured to generate the rectangular-wave high-frequency voltage, for example, by switching a given DC voltage from a DC power supply, using a switching element capable of a high-speed operation, such as a power MOSFET, as disclosed, for example, in the Patent Document 1 and the Non-Patent Document 1. In this configuration, generation, stopping and re-starting of the high-frequency voltage can be performed at a high speed.

For example, in the state when ions are trapped by applying the rectangular-wave high-frequency voltage to the ring electrode of the three-dimensional quadrupole ion trap, when the application of the rectangular-wave high-frequency voltage is stopped, no high-frequency electric field will act on ions entering into the ion trap, for example, through an ion entrance port provided in the endcap electrode, to allow the ions to more easily pass through the ion entrance port. That is, the ions will be more easily trapped within the ion trap. Although the disappearance of the high-frequency electric field will spoil a confining force against ions stably trapped within the ion trap just before the stopping, to cause dispersion of the ions, it is not that all the ions vanish in a moment. Thus, the high-frequency voltage application is re-stared before an elapse of an appropriate time from a time point of the stop of the high-frequency voltage application, to allow at least a part of the previously-trapped ions to be re-trapped together with the newly (i.e., additionally)-introduced ions. This makes it possible to reliably increase an amount of ions trapped within the ion trap so as to subject a larger amount of ions to mass spectrometry analysis.

While a shortened time-period of stopping of the high-frequency voltage application allows a reduction in amount of ions due to dispersion of ions trapped just before the stopping to be suppressed, an amount of ions to be newly introduced will also be reduced, and a mass range will become fairly narrow. Thus, in one embodiment, the time-period where the high-frequency voltage application is stopped to introduce ions into the ion trap, is preferably set in the range of 1 to 50 μs.

According to experimental tests of the inventors of this application, at least a part of ions trapped just before the stopping can be re-trapped by setting the time-period of stopping of the high-frequency voltage application, at 50 μs or less. Further, a mass range of newly introduceable ions can be kept in a certain level of satisfactory range by setting the time-period of stopping of the high-frequency voltage application, at 1 μs or more.

Preferably, the ion trap mass spectrometer of the present invention is configured to repeatedly perform a cycle comprising introducing ions into the ion trap and trapping the ions within the ion trap, plural times, and then subject ions trapped within the ion trap to mass separation and detection.

In the series of mass spectrometry analysis cycles as mentioned above, a time-period required for the mass separation and detection of ions and an integration processing of mass profiles is relatively long as compared with a time-period required for the introduction and trapping of ions into/by the ion trap. Thus, the ion introduction/trapping into/by the ion trap is repeated plural times to increase an amount of ions accumulated within the ion trap, and then the accumulated ions are subjected to the mass separation/detection, to allow an S/N ratio of a resulting mass spectrum to be improved without significantly increasing a measurement time per sample.

However, when ions are introduced into the ion trap, a mass range of introduceable/trappable ions varies depending on a condition for the ion introduction. Thus, if ions are repeatedly introduced while maintaining the same condition for the ion introduction, the mass rage is not widened, although a signal intensity of ions falling within a specific mass range is increased. Thus, when it is desired to widen a mass range of ions to be subjected to mass spectrometry analysis, the condition for the ion introduction is preferably changed at least once during the multicycle repetitive ion introduction into the ion trap.

For example, the condition for the ion introduction is a time-period where the high-frequency voltage application is stopped to introduce ions into the ion trap. When this time-period is increased, a mass range of ions introducible and trappable in the ion trap can be shifted along a mass axis.

Another condition for the ion introduction includes an ion accelerating voltage determined by the static electric field formed within the ion trap when ions are introduced into the ion trap, and a voltage applied to an ion transport optical system operable to transport ion to the ion trap. When the accelerating voltage is changed, a kinetic energy to be given to ions having the same mass is changed to cause a change in time-period before the ions reach the trapping space of the ion trap. Thus, the mass range of ions introduceable and trappable into/in the ion trap can be shifted along the mass axis by changing the accelerating voltage while keeping a time-period required for the introduction constant.

Preferably, the ion trap mass spectrometer of the present invention further comprises gas introduction means operable to introduce a cooling gas into the ion trap in synchronization with the ion introduction into the ion trap.

When a cooling gas is supplied into the ion trap in advance of the additional ion introduction into the ion trap, ions previously trapped within the ion trap collide with the cooling gas to suppress the occurrence of an undesirable situation where ions disperse to cause a collision with the electrodes or a direct ejection from the ion trap, even in a state when the high-frequency electric field is not formed. This makes it possible to increase a probability of allowing ions to be trapped, so as to efficiently accumulate ions within the ion trap, when the high-frequency voltage application is re-started.

In the ion trap mass spectrometer of the present invention, in a state when ions are trapped in the ion trap, newly-produced ions can be additionally introduced into the ion trap. This makes it possible to increase an amount of ions trappable in the ion trap and then subject the ions to mass separation/detection, so that a target ion can be detected with a high signal intensity, and an S/N ratio of a mass spectrum can also be improved. In addition, even if the conventional operation of repeating a mass spectrometry analysis and subjecting the profiles to an integration processing is eliminated, or the number of the repetitive mass spectrometry analysis cycles and the integration processings is reduced, a mass spectrum having a sufficiently high S/N ratio can be created, and therefore a measurement time can be drastically reduced. This makes it possible to achieve enhancement in analytic throughput and reduction in cost required for mass spectrometry analysis per sample.

Furthermore, in the ion trap mass spectrometer of the present invention, a mass range of ions accumulatable in the ion trap can be widened by changing the condition for the ion introduction during the repetitive cycles of ion introduction and ion trapping. This makes it possible to create a mass spectrum covering a wider mass range in one mass spectrometry analysis.

DESCRIPTION OF THE EXEMPLARY EMBODIMENTS

Figure 1:
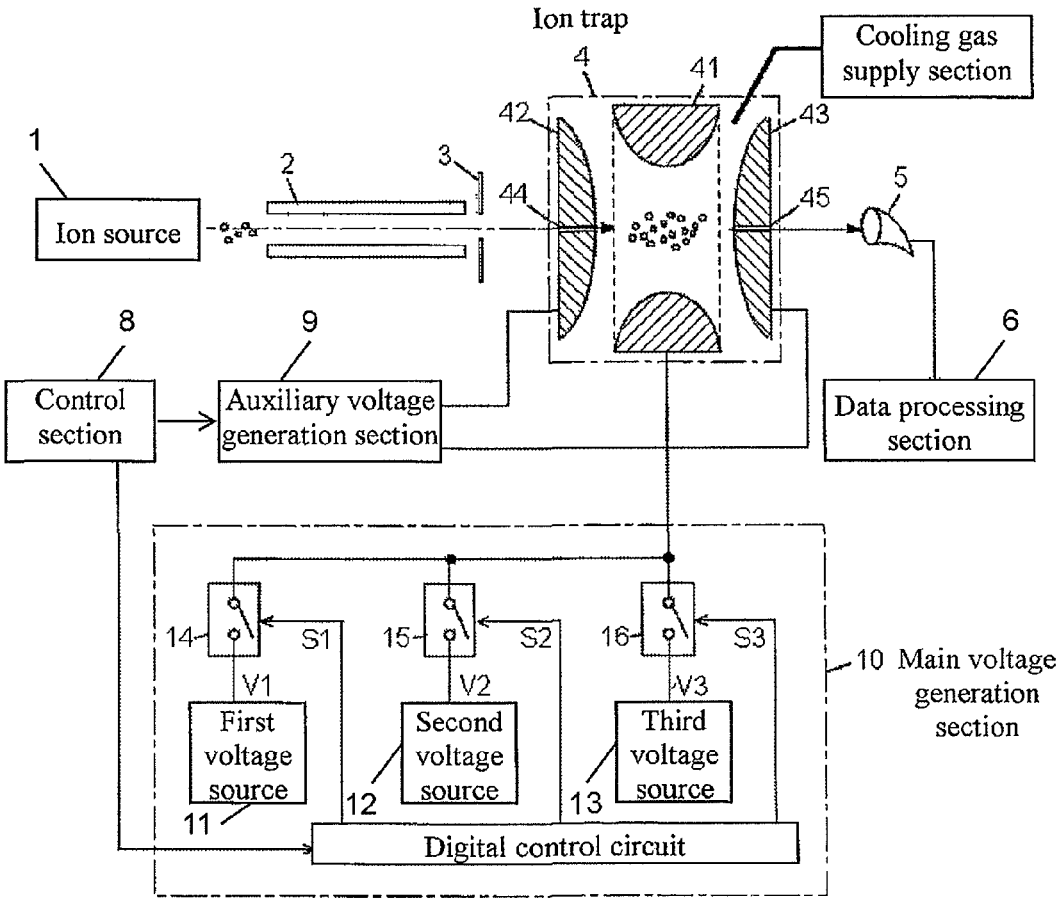
FIG. 1 is a fragmentary block diagram showing an ion trap mass spectrometer according to one embodiment of the present invention.

With reference to the drawings, an ion trap mass spectrometer according to one embodiment of the present invention will now be specifically described. FIG. 1 is a fragmentary block diagram showing the ion trap mass spectrometer according to this embodiment.

The ion trap mass spectrometer comprises an ion source 1, an ion transport optical system 2, a three-dimensional quadrupole ion trap 4, and an ion detector 5. In this embodiment, the ion source 1 is composed of an atmospheric pressure matrix-associated laser desorption/ionization (AP-MALDI) source. Alternatively, the ion source 1 may be composed of another type of atmospheric pressure ion source, or may be composed of an ion source operable to perform ionization under a vacuum atmosphere, instead of under an atmospheric pressure. Ions produced under an atmospheric pressure by the ion source 1 are introduced into a vacuum atmosphere by the configuration of a differential pumping system (not shown), and transported through the ion transport optical system 2. In this embodiment, the ion transport optical system 2 is composed of an ion lens applied with a high-frequency voltage (actually, a voltage formed by superimposing a high-frequency voltage and a DC voltage). For example, a multipolar rod-type configuration may be used as the ion transport optical system. In a configuration where the ion source 1 is arranged in a vacuum atmosphere, an electrostatic lens, such as an Einzel lens, may be used as the ion transport optical system.

The ion trap 4 comprises one annular-shaped ring electrode 41 having an inner surface in the shape of a hyperboloid of revolution of one sheet, and a pair of endcap electrodes 42, 43 disposed in opposed relation to each other across the ring electrode to have inner surfaces in the shape of a hyperboloid of revolution of two sheets. A space surrounded by the electrodes 41, 42, 43 serves as a trapping region. A main voltage generation section 10 is connected to the ring electrode 41, and an auxiliary voltage generation section 9 is connected to each of the endcap electrodes 42, 43. Each of the voltage generation sections 9, 10 is controlled by a control section 8. The entrance-side endcap electrode 42 has an ion entrance port 44 formed at a center thereof and the exit-side endcap electrode 43 has an ion exit port 45 formed to substantially align with the ion entrance port 44.

A gate electrode 3 is disposed at an outlet of the ion transport optical system 2 and outside the ion entrance port 44 of the ion trap 4. Although not illustrated, the gate electrode 3 is operable, according to control of a voltage to be applied thereto, to allow ions to be temporarily accumulated within the ion transport optical system 2 before being introduced into the ion trap 4, 50 as to be introduced into the ion trap 4 in a pulsed manner. A cooling das supply section 7 including a pulse valve is provided to controllably introduce a cooling gas (typically, He gas) into the ion trap 4.

In this embodiment, the ion trap 4 serves as not only a means to trap and accumulate ions but also a mass analyzer for separating ions depending on their masses (exactly, mass-to-charge ratio m/z). The ion detector 5 is arranged outside the ion exit port 45 of the ion trap 4. The ion detector 5 comprises a conversion dynode for converting an ion into an electron, and a secondary electron multiplier tube, so that it is operable to send a detection signal depending on an amount of entered ions to a data processing section 6.

In the ion trap spectrometer according to this embodiment, the ion trap 4 is a so-called digital ion trap (DIT), and the main voltage generation section 10 comprises a circuit for switching a DC voltage having a given voltage value to generate a rectangular-wave high-frequency voltage. Specifically, a digital control circuit 17 includes a circuit for generating a reference clock signal having a given frequency, a counter circuit for counting the reference clock signal, and a gate circuit for subjecting an output of the counter circuit to a logical operation, so that it is operable, based on an instruction of the control section 8, to generate and output aftermentioned three control pulse sequences S1, S2, S3. The control pulse sequence S1, the control pulse sequence S2 and the control pulse sequence S3 drive a first switch 14 for turning on/off a DC voltage V1 generated by a first voltage source 11, a second switch 15 for turning on/off a DC voltage V2 generated by a second voltage source 12, and a third switch 16 for turning on/off a DC voltage V3 generated by a third voltage source 13, respectively.

Each of the first to third switches 14, 15, 16 is composed of a switching element capable of a high-speed operation, such as a power MOSFET. The digital control circuit 17 is operable to turn on only any one of the first to third switches 14, 15, 16 to selectively output a voltage corresponding to the switch placed in its ON state. Thus, a combination pattern of "1 (H level)" and "0 (L level)" of the three control pulse sequences S1, S2, S3 determines a change pattern of the rectangular-wave high-frequency voltage to be output from the main voltage generation section 10.

Figure 2:
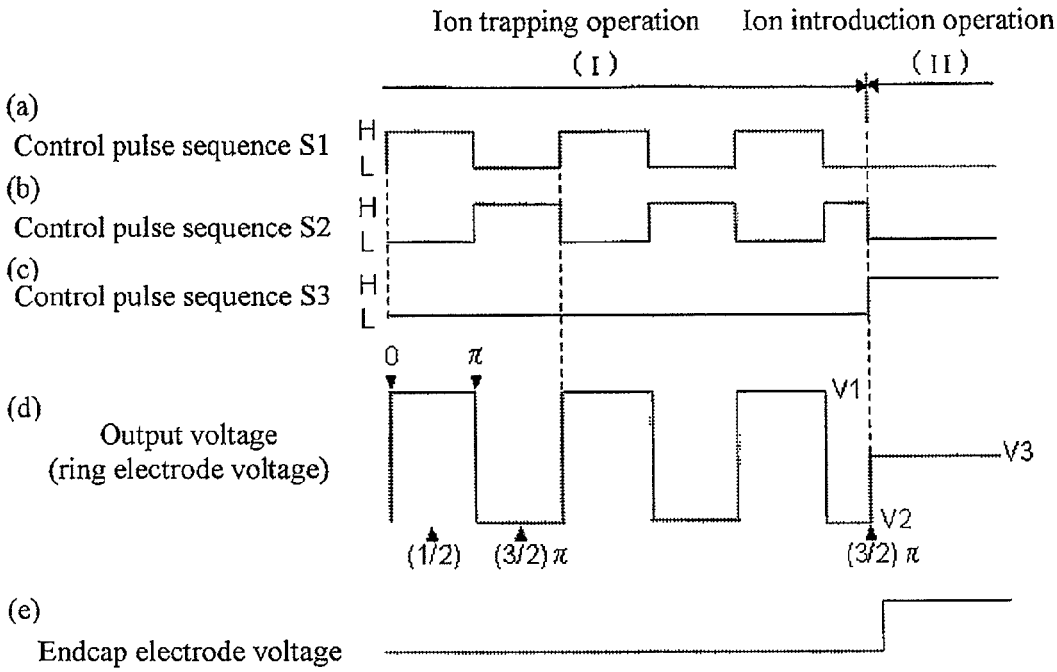
FIG. 2 is a waveform chart showing a relationship between a driving control pulse sequence and voltages to be applied to a ring electrode and an endcap electrode.

FIG. 2 is a waveform chart showing a relationship between the control pulse sequences S1, S2, S3 and voltages to be applied to the ring electrode 41 and the endcap electrodes 42, 43.

In an operation of trapping ions within the ion trap 4, the pattern of the control pulse sequences S1, S2, S3 are set as shown in the stage (I) in FIG. 2(*a*), (*b*) and (*c*). Consequently, as shown in FIG. 2(*d*), a rectangular-wave high-frequency voltage having a high level V1 and a low level V2 is applied to the ring electrode 41. During this operation, each of the endcap electrodes 42, 43 is set in a grounded state, or applied with an appropriate DC voltage. A high-frequency electric field is formed within the ion trap 4 according to the high-frequency voltage applied in the above manner, and ions in the ion trap 4 are trapped around a central zone of the trapping region while alternately receiving attraction and repulsion. As above, during the operation of trapping ions within the ion trap 4, each of the voltages V1, V2 can be arbitrarily set depending on the voltage sources 11, 12. For example, V1 and V2 may be set at +500 [V] and −500 [V], respectively. A frequency f of the rectangular wave can be arbitrarily set by the digital control circuit 17. Typically, it is set in the range of about several ten kHz to about several MHz.

If the above ion-trapping high-frequency electric field is formed within the ion trap 4 during an operation of introducing ions into the ion trap 4 through the ion entrance port 44, ions are hardly introduced due to an influence of an electric field leaking out through the ion entrance port 44. Thus, during the ion introduction operation, the pattern of the control pulse sequences S1, S2, S3 is set to be (0, 0, 1) as shown in the stage (II) in FIG. 2. Consequently, the voltage to be applied from the main voltage generation section 10 to the ring electrode 41 is changed to a constant voltage V3, i.e., a DC voltage. This voltage V3 can be arbitrarily set depending on the voltage source 13. For example, the V3 may be set at 0 [V]. During the ion introduction operation, an appropriate DC voltage is applied to each of the endcap electrodes 42, 43. Typically, a voltage of 0 [V], or a voltage having the same polarity as that of ions to be introduced, is applied to the exit-side endcap electrode 43, to allow ions moving toward the exit-side endcap electrode 43 after being introduced into the ion trap 4 to rebound toward the trapping region.

While a high-frequency electric field is formed within the ion trap 4 during the ion trapping operation, primarily by the rectangular-wave high-frequency voltage applied to the ring electrode, the high-frequency voltage application is steeply stopped in a transition to the ion trapping operation, and only a static electric field (DC electric current) is formed within the ion trap 4. Thus, differently from the high-frequency electric field, the static electric field allows ions to be easily introduced from the outside into the ion trap 4 through the ion entrance port 44. As above, in a state when previously-introduced ions are trapped within the ion trap 4 by the high-frequency electric field, ions can be additionally introduced into the ion trap 4 simply by temporarily stopping the high-frequency voltage application to form a static electric field within the ion trap 4.

However, in response to disappearance of the high-frequency electric field within the ion trap 4, a confining force against previously-trapped ions is spoiled to cause dispersion of the ions. Thus, if this state is continued, the ions will finally vanish away due to collision with the inner surfaces of the electrodes 41, 42, 43, and escape from the ion exit port 45. Thus, it is necessary to adequately set a time-period where the high-frequency voltage application is stopped for ion introduce, i.e., a given time-period t from a time when the voltage to be applied to the ring electrode 4 is changed from the repetition of V1 and V2 to the constant voltage V3 through until the high-frequency voltage application, so as to suppress a reduction in amount of ions previously trapped within the ion trap 4, while newly introducing ions and trapping the newly-introduced ions together with the previously-trapped ions.

Figure 5:
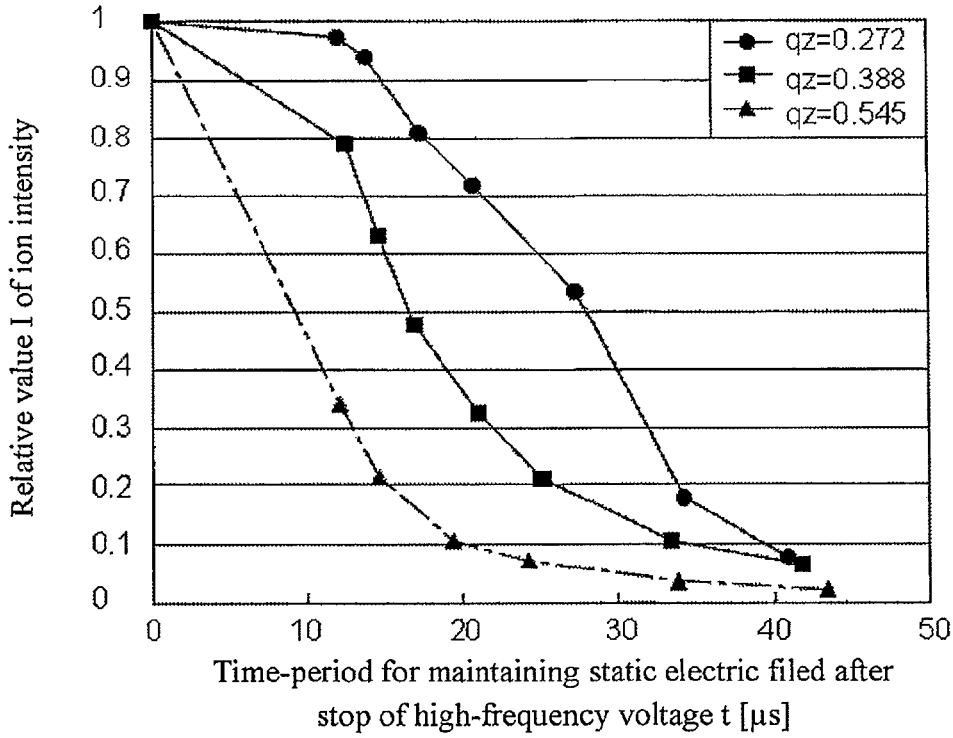
FIG. 5 shows a result obtained by actually measuring a relationship between a stop time-period of high-frequency voltage application and a detected ion intensity.

FIG. 5 is a graph showing a result of an experimental test carried out by the inventors. In this test, the stopping of the high-frequency voltage application was continued (the voltage to be applied to the ring electrode 4 was maintained at the V3) for the given time-period t after ions are introduced into the ion trap 4, and then the high-frequency voltage application was re-started to trap ions by the high-frequency electric field, whereafter the trapped ions were subjected to mass analysis, and an ion intensity was detected using the ion detector 5. Then, a relationship between the given time-period t and the detected ion intensity was determined while changing the given time-period. In this test, the high-frequency voltage was generated under the following conditions: V1=+500 [V], V2=−500 [V], V3=0 [V], and f=585, 478, 414 [kHz], and changed from its ON state to its OFF state at a timing when a phase of the rectangular wave thereof is at (3/2) π, as shown in FIG. 2. It is understood that the turn-off operation of the high-frequency voltage can be performed at a high speed, as mentioned above.

The vertical axis of the graph in FIG. 5 represents a value at t=0, i.e., a value normalized by an ion intensity when the high-frequency voltage is not stopped. Further, qz=0.272, 0.388 and 0.545 indicate curves obtained when the ion trap is operated under conditions that a target ion to be measured is located at points (az, qz)=(0, 0.272), (0, 0.388) and (0, 0.545) in a ion-trapping stable region expressed by an az-qz plane, respectively. Just for reference, a boundary of the stable region in a digital ion trap is (az, qz)=(0, 0.7125).

As is clear from FIG. 5, at least a part of ions trapped within the ion trap 4 will remain within the ion trap 4 for about several ten μs after the voltage to be applied to the ring electrode 41 is set at the constant voltage V3. In qz=0.272 which is the best conditions, almost all the ions remain within the ion trap 4 for ten-odd μs, and about one-half of the ions remain within the ion trap 4 for about 30 μs. Thus, the time-period t of stopping of the high-frequency voltage application can be set to fall within the above range to allow at least a part of ions trapped within the ion trap 4 just before the stopping to remain within the ion trap 4, and additionally-introduced ions can be added to the remaining ions to increase a total amount of ions to be accumulated within the ion trap 4.

Figure 3:
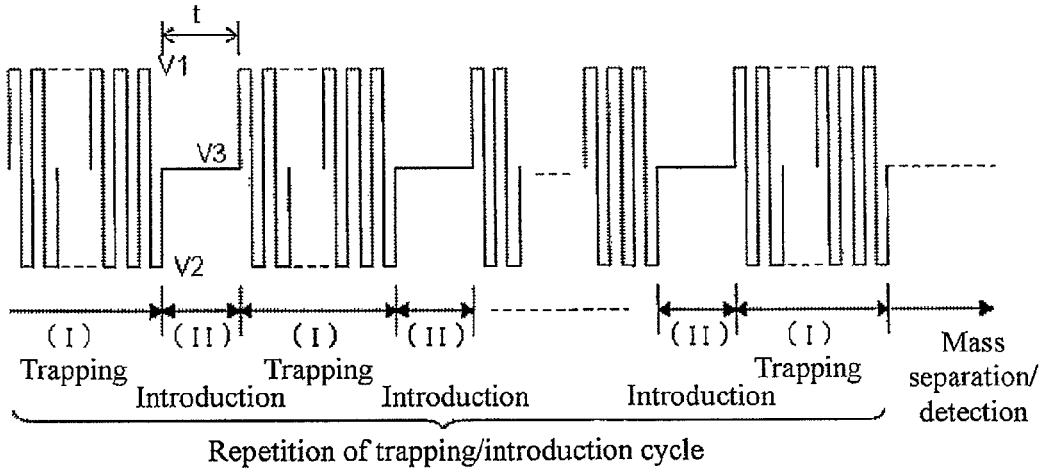
FIG. 3 is a schematic diagram showing a waveform of a voltage to be applied to the ring electrode during a series of mass spectrometry analysis operations.

In the ion trap mass spectrometer according to this embodiment, as shown in FIG. 3, the operation of applying the rectangular-wave high-frequency voltage to the ring electrode 41 to trap ions within the ion trap 4, and the operation of setting the voltage to be applied to the ring electrode 41 at a constant value to introduce ions subsequently transported by the ion transport optical system 2, into the ion trap additionally and efficiently, are alternately repeated under control of the control section 8. After an amount of ions accumulated within the ion trap 4 is sufficiently increased by repeating a cycle of the ion trapping and the ion introduction appropriate times in the above manner, the accumulated ions are subjected to mass separation and detection in a conventional manner. This makes it possible to increase an amount of ions to be subjected to ion spectrometry analysis, to provide a higher signal intensity in the ion detector 5 so as to allow the mass spectrometry analysis to be performed at an adequate S/N ratio. Preferably, the gate electrode 3 may be controlled to send out ions previously accumulated in the ion transport optical system 2, toward the ion entrance port 44, in conjunction with a start timing of each ion introduction in the operation of repeatedly introducing ions into the ion trap 4.

It is necessary to determine the time-period t where the high-frequency voltage application is stopped for ion introduce, in the aforementioned manner. In addition, as to a time-period required for trapping ions, it is also necessary to ensure a certain level of sufficient time-period. The reason is as follows: Even if the high-frequency electric field is formed within the ion trap 4 in response to re-start of the high-frequency voltage application to the ring electrode 41, it takes a certain time before behavior of ions becomes actually stable. Thus, if the high-frequency voltage application is stopped for next ion introduction before the behavior becomes stable, the ions within the ion trap 4 will undesirably disperse in a short time-period. Thus, the time-period for trapping ions after the ion introduction is desirably ensured in the range of about several ms to several ten ms.

Preferably, a cooling gas may be introduced from the cooling gas supply section 7 into the ion trap 4 in a pulsed manner, in synchronization with the ion introduction during the above repetitive cycle of the operation of additionally introducing ions into the ion trap 4 and the operation of trapping ions, for example, just before the ion introduction. When the cooling gas is supplied into the ion trap 4 in this manner, a kinetic energy of ions previously trapped within the ion trap 4 is consumed due to collision with the cooling gas. The disappearance of the high-frequency electric field spoils a confining force against ions stably trapped within the ion trap 4, and thereby the ions are likely to escape, for example, from the ion exit port 45, without remaining within the ion trap 4. The above technique of consuming the kinetic energy makes it possible to increase a possibility that the previously-trapped ions remain within the ion trap 4.

Figure 6:
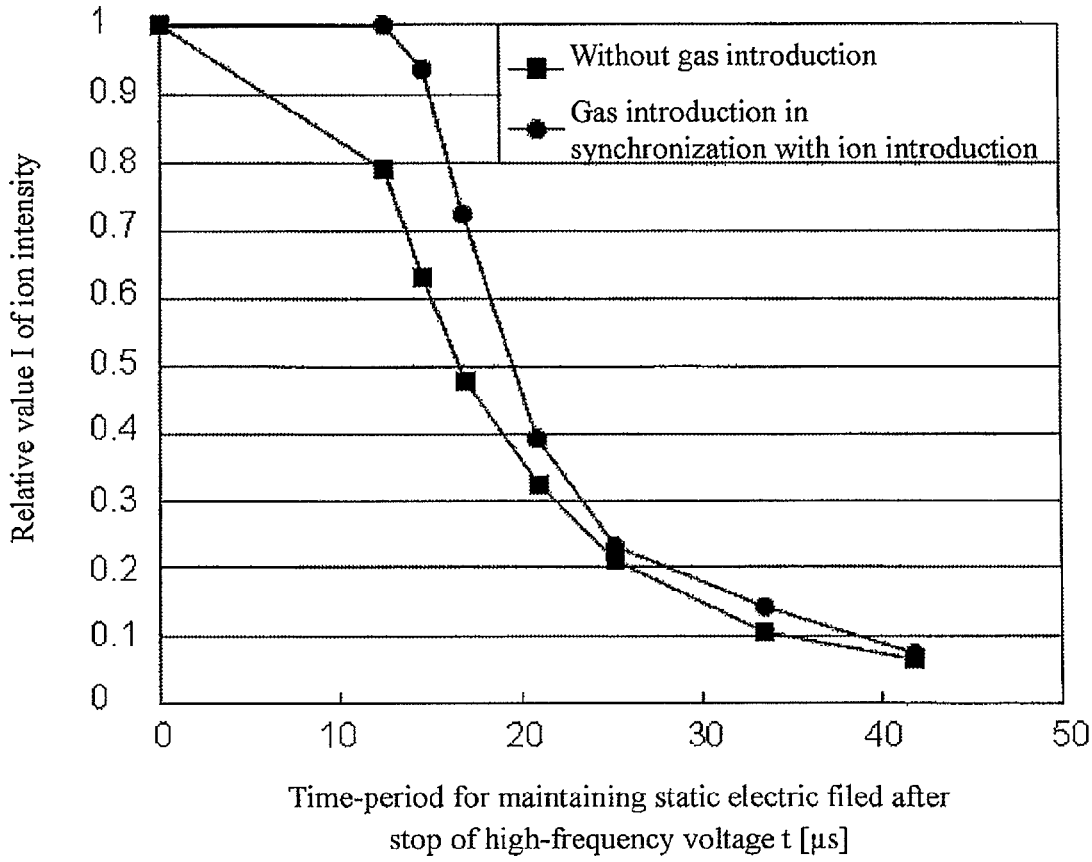
FIG. 6 shows a result obtained by actually measuring a relationship between a stop time-period of high-frequency voltage application and a detected ion intensity under conditions with/without a cooling gas.

FIG. 6 is a graph showing a result of a test for verifying an advantageous effect of the cooling gas introduction. Conditions of this test are the same as those in the test for the result illustrated in FIG. 5. In this test, a detected ion intensity was obtained under two measurement conditions with and without the cooling gas introduction in synchronization with the ion introduction during the operation of introducing ions into the ion trap 4. The ion trap 4 was operated under a condition that a target ion is located at the point (az, qz) (0, 0.388) in the ion-trapping stable region expressed by the az-qz plane.

As seen in FIG. 6, an efficiency of ion tapping within the ion trap 4 is enhanced by introducing the cooling gas. Particularly, in cases where the time-period of stopping of the high-frequency voltage application is relatively short (in this test, up to 20 μs), an effect of enhancing the ion trapping efficiency is significant. In view of this result, it can be said that, in terms of improving the S/N ratio in the mass spectrometry analysis, it is effective to supply the cooling gas into the ion trap 4 in synchronization with the ion introduction during the operation of additionally introducing ions into the ion trap 4 in a repetitive manner.

The ion behavior after disappearance of the high-frequency electric field which has allowed ions to be trapped within the ion trap 4 is dependent on a timing of the disappearance of the high-frequency electric field, specifically, a phase of a waveform of the high-frequency voltage at a time when the high-frequency voltage application is stopped. An ion cloud which is an aggregation of ions in the high-frequency electric field is alternately placed in a state when it concentrates around the central zone of the trapping region and in a state when it spreads over a peripheral zone of the trapping region in a repetitive manner. Thus, it is believed that the ion dispersion is more delayed by turning off the high-frequency electric field when the ions are moving toward the central zone, as compared with when the ions are spreadingly moving toward the peripheral zone. In the ion trap mass spectrometer according to this embodiment, the timing of stopping of the high-frequency voltage application (timing of changing the voltage to V3) can be arbitrarily set in principle. Thus, ions can be more efficiently accumulated within the ion trap 4 by stopping the high-frequency voltage application at a phase of the high-frequency voltage determined in consideration of the above ion behavior.

It is considered that a timing of re-starting the high-frequency voltage application after the ion introduction is also important. It can be estimated that, in a state when only the static electric field is formed without the high-frequency electric field, ions entering the ion trap 4 are elongatedly distributed in a direction along a straight line connecting the ion entrance port 44 and the ion exit port 45. Thus, if the high-frequency electric field is formed in a direction causing the ions to spread toward both sides of the straight line during re-start of the high-frequency voltage application, the ions are more likely to escape from the ion entrance port 44 and the ion exit port 45, and collide with the endcap electrodes 42, 43. Therefore, it would be desirable to form the high-frequency electric field in a direction causing ions residing along the straight line to contract inwardly, during re-start of the high-frequency voltage application. Ions can be more efficiently accumulated within the ion trap 4 by re-starting the high-frequency voltage application at an adequate phase determined in consideration of the ion behavior during re-start of the high-frequency voltage application.

In the technique of stopping the high-frequency voltage application to the ring electrode 45 to form the static electric field within the ion trap 4, and then introducing ions into the ion trap 4, a mass range of ions introduceable into the ion trap 4 at once is dependent on a condition (i.e., parameter) for the ion introduction, such the ion introduction time-period, the static electric field to be formed within the ion trap 4 during the ion introducing, or the voltage to be applied to the ion lens of the ion transport optical system 2.

Specifically, in the above configuration where the gate electrode 3 is operable to control release of ions from the ion transport optical system 2, ions having a lower mass reach the ion entrance port 44 of the ion trap 4 at an earlier timing, instead of ions having various masses reaching the ion entrance port 44 exactly at the same timing. Thus, as the ion introduction time-period becomes shorter, the mass range of ions introduceable into the ion trap 4 is shifted to a lower mass region. Further, during the ion introduction, ions are accelerated by a difference between respective static electric fields of the ion trap 4 and the ion transport optical system 2, and an energy required for the acceleration is constant regardless of mass. That is, a velocity of ions has a mass dependence. Thus, if the ion velocity is excessively large relative to the ion introduction time-period, ions entering the ion trap 4 will undesirably pass through the trapping region before the high-frequency electric field is re-formed. Therefore, a mass range trappable within the ion trap 4 varies depending on the above condition (i.e., parameter) for determining an ion accelerating voltage.

For the above reason, even in the operation of repeatedly introducing ions into the ion trap 4, if the ion introduction time-period is constant, and the condition for the ion introduction, such as the ion accelerating voltage, are constant, the mass range of trappable ions during each of the ion introductions will become constant, and a mass range of a mass spectrum to be obtained will become relatively narrow (it is understood that this is desirable if it is solely intended to increase a signal intensity). Thus, in order to widen a mass range of mass-analyzable ions, the ion introduction time-period t may be changed, or the above condition for determining the ion accelerating voltage may be changed, during the operation of repeatedly introducing ions into the ion trap 4.

Figure 4:
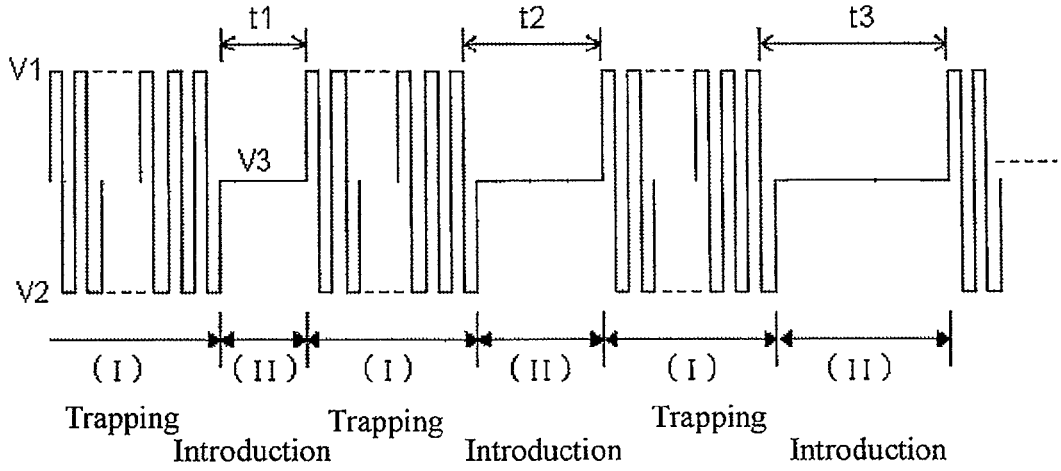
FIG. 4 is a schematic diagram showing a waveform of a voltage to be applied to the ring electrode when an ion introduction time-period is changed during ion introduction.

FIG. 4 is a schematic diagram showing a waveform of a voltage to be applied to the ring electrode 41 when the ion introduction time-period t is changed during the ion introduction. In this case, the ion introduction time-period is changed from t1 to t2, t3, - - - , every time the ion introduction is repeated. As the ion introduction time-period becomes longer, the mass range of ions introduceable into the ion trap 4 is shifted to a higher mass region. Thus, the higher-mass ions can be added to lower-mass ions previously introduced and trapped under a shorter ion introduction time-period, to accumulate ions within the ion trap 4 in a wider mass range, and a total of these ions can be subjected to mass spectrometry analysis.

In the same manner, either one the static electric field within the ion trap 4 and the voltage to be applied to the ion lens of the ion transport optical system 2 may be changed in such a manner that the voltage for accelerating ions to be introduced into the ion trap 4 (i.e., ion accelerating voltage) is changed in each of the ion introductions. In this case, the mass range of ions introduceable into the ion trap 4 is shifted along a mass axis, so that ions can be accumulated within the ion trap 4 in a wider mass range, and then subjected to mass spectrometry analysis.

In cases where an MALDI source is used as the ion source 1, ions generated by plural laser beam irradiations can be accumulated within the ion tap 4, and then subjected to mass spectrometry analysis at once. Thus, a need for subjecting a plurality of mass profiles to an integration processing as in the conventional ion trap mass spectrometer can be eliminated to reduce a measurement time-period. This makes it possible to provide an enhanced measurement throughput. Particularly, in mass spectrometry imaging where mass spectrometry analysis for different positions on a sample is repeated to create a spatial distribution image of molecules contained in the sample, the above effect of reducing a measurement time-period is significant. It is understood that an ion mass range of ions measurable at once can also be widened.

The above embodiment is one example, and it is to be understood that various modifications, changes and additions may be appropriately made therein without departing from the scope of the present invention hereinafter defined, and they should be construed as being included therein. For example, while the ion trap in the above embodiment is composed of a three-dimensional quadrupole ion trap comprising one ring electrode and two, endcap electrodes, the present invention may also be applied to an ion trap comprising a multipolar (e.g., quadrupolar) rod and a pair of endcap electrodes disposed at respective open ends thereof (i.e., so-called "linear ion trap).

What is claimed is:

1. An ion trap mass spectrometer including an ion source operable to produce ions, and an ion trap operable to trap ions by means of an electric field formed in a space surrounded by a plurality of electrodes, wherein ions produced by said ion source are introduced into said ion trap so as to be trapped therein, and then said trapped ions are mass-separated by said ion trap, or mass-separated after being discharged from said ion trap, whereafter said mass-separated ions are subjected to detection, said ion trap mass spectrometer being characterized by comprising:

a) voltage application means operable to apply a rectangular-wave high-frequency voltage to at least one of said plurality of electrodes constituting said ion trap so as to form an ion-trapping high-frequency electric field within said ion trap; and b) control means operable to control said voltage application means in such a manner as to, in a state when ions are trapped within said ion trap by applying said rectangular-wave high-frequency voltage to said at least one of said plurality of electrodes, temporarily stop said high-frequency voltage application so as to form a static electric field within said ion trap to introduce ions from an outside of said ion trap, and, after an elapse of a given time, re-start said high-frequency voltage application so as to trap said newly-introduced ions in addition to said previously-trapped ions.

2. The ion trap mass spectrometer as defined in claim 1, wherein a time-period where said high-frequency voltage application is stopped to introduce ions into said ion trap, is set in the range of 1 to 50 μs.

3. The ion trap mass spectrometer as defined in claim 1, which is configured to repeatedly perform a cycle comprising introducing ions into said ion trap and trapping said ions within said ion trap, plural times, and then subject ions trapped within said ion trap to mass separation and detection.

4. The ion trap mass spectrometer as defined in claim 3, which is configured to, during said multicycle repetitive ion introduction into said ion trap, change a condition for said ion introduction, at least once.

5. The ion trap mass spectrometer as defined in claim 4, wherein said condition for said ion introduction is a time-period where said high-frequency voltage application is stopped to introduce ions into said ion trap.

6. The ion trap mass spectrometer as defined in claim 4, wherein said condition for said ion introduction is an ion accelerating voltage determined by said static electric field formed within said ion trap when ions are introduced into said ion trap, and a voltage applied to an ion transport optical system operable to transport ion to said ion trap.

7. The ion trap mass spectrometer as defined in claim 1, which further comprises gas introduction means operable to introduce a cooling gas into said ion trap in synchronization with said ion introduction into said ion trap.

8. The ion trap mass spectrometer as defined in claim 1, wherein said ion trap is a three-dimensional quadrupole ion trap having a ring electrode and a pair of endcap electrodes, wherein said rectangular-wave high-frequency voltage is applied to said ring electrode.

* * * * *